US006544359B1

(12) United States Patent
Bäckerud

(10) Patent No.: US 6,544,359 B1
(45) Date of Patent: Apr. 8, 2003

(54) METHOD TO PRODUCE COMPACTED GRAPHITE IRON (CGI)

(75) Inventor: Lennart Bäckerud, Stockholm (SE)

(73) Assignee: CGI-Promotion AB, Ronneby (SE)

( * ) Notice: Subject to any disclaimer, the term of this patent is extended or adjusted under 35 U.S.C. 154(b) by 0 days.

(21) Appl. No.: 09/647,103

(22) PCT Filed: Mar. 23, 1999

(86) PCT No.: PCT/SE99/00456

§ 371 (c)(1),
(2), (4) Date: Sep. 26, 2000

(87) PCT Pub. No.: WO99/50467

PCT Pub. Date: Oct. 7, 1999

(30) Foreign Application Priority Data

Mar. 27, 1998 (SE) ..... 9801069

(51) Int. Cl.[7] ..... C21D 5/00

(52) U.S. Cl. ..... 148/543; 148/612; 148/614; 164/4.1; 164/57.1

(58) Field of Search ..... 148/543, 612, 148/614; 164/4.1, 57.1

(56) References Cited

U.S. PATENT DOCUMENTS 4,667,725 A * 5/1987 Backerud ..... 164/4.1
4,806,157 A * 2/1989 Subramanian ..... 420/30

FOREIGN PATENT DOCUMENTS

DE 35 04 432 10/1986

OTHER PUBLICATIONS

Elliott, "Cast Iron Technology", Butterworths, (1988), vol. 18, pp. 20–24 and 64.
ASM Specialty Handbook, Cast Iron, edited by J.R. Davies, Davies Assoc., (1996), pp. 3–15 and 80–93.

* cited by examiner

*Primary Examiner*—George Wyszomierski
*Assistant Examiner*—Janelle Combs Morillo
(74) *Attorney, Agent, or Firm*—Browdy and Neimark, P.L.L.C.

(57) ABSTRACT

The invention relates to a method of producing objects of cast iron containing compacted (vermicular) graphite crystals, by preparing a cast iron melt having substantially a carbon content at the desired final level and a silicon content below the desired final value, so that the equilibrium temperature (TE) for the reaction between carbon and $SiO_2$ falls near 1400° C., and adjusting the temperature of the melt (TM) to a value between the equilibrium temperature (TE) and the "boiling temperature" (TB), to allow absorption of oxygen by the melt to a level exceeding the desired level at the time the melt is poured into a mold, adding the required amount of silicon, and thereafter reducing the oxygen content by addition of magnesium or magnesium containing material, preferably a FeSiMg-alloy to an oxygen level of 10 to 20 ppm oxygen in liquid solution, and forming particles of magnesium silicates as well as cast objects obtained by the method.

12 Claims, No Drawings

METHOD TO PRODUCE COMPACTED GRAPHITE IRON (CGI)

CROSS REFERENCE TO RELATED APPLICATION

The present application is the national stage under 35 U.S.C. 371 of PCT/SE99/00456, filed Mar. 23, 1999.

INTRODUCTION

Cast irons can be divided into four major groups, flake graphite, malleable, spheroidal and compacted graphite iron (CGI) as described in Cast Iron Technology by Roy Elliott, Butterworths 1988 and in ASM Specialty Handbook, Cast Iron, edited by J. R. Davis, Davis & Associates 1996, the disclosures of which are herewith incorporated by reference. In malleable iron graphite phase is formed as a result of a solid state reaction, but in the other kinds of iron, graphite is precipitated out of the liquid during solidification. Depending on nucleating particles present in the melt and on the prevailing constitutional conditions (i.e. the presence of certain alloying elements and impurities) the various forms of graphite crystals are growing from the melt, as flakes, nodules or compacted (vermicular) crystals. Cast iron with various forms of graphite exhibits different mechanical and physical properties. Cast iron with compacted graphite, defined as Type IV in ASTM A 247 is characterised by high strength, reasonable ductility, good heat conductivity and high damping capacity, which makes the material especially interesting for production of engine blocks, cylinder heads, exhaust manifolds, disk breaks and similar products for the automotive industry. The material is, however, rather difficult to produce as it requires specific nuclei and a very narrow control of elements like sulphur and oxygen. The present invention describes a method by which these requirements can be fulfilled during a foundry production process.

First a review of different kinds of nucleating particles is presented:

Flake Graphite

Normally nucleating particles consist of saturated $SiO_2$ (cristobalite or tridymite) which are formed at high silicon and oxygen contents, the reaction of Si to $SiO_2$ occurs within the normal casting temperature range and there is a good lattice fit (epitaxy) between the graphite crystals and cristobalite. The formation of $SiO_2$ particles may, by kinetic reasons, be facilitated by the presence of stable oxide particles like $Al_2O_3$.

Compacted Graphite Iron (CGI)

It has been found that in compacted graphite iron $SiO_2$ particles are not very efficient as nucleating particles but so are various forms of magnesium silicates. In cases where $SiO_2$ is present there is a great risk that graphite flakes nucleate, which is disastrous for the compacted graphite iron quality. The silicate particles are, however, good nucleants for the compacted graphite crystals which will develop in full provided the remaining oxygen content, after magnesium-treatment of the melt, is kept in a suitable range normally between 20 to 60 ppm.

Nodular Iron

It is not quite clear what kind of nucleating particles are the most efficient in triggering the growth of nodular graphite particles, which, due to heavy desoxidization, to a remaining oxygen concentration between 5 and 10 ppm, develop in a nodular form.

It is obvious from above, that in gray cast iron and in compacted graphite iron, nucleant particles consist of desoxidization products, in gray iron preferentially silica ($SiO_2$) and in compacted graphite iron, after the addition of magnesium, of magnesium silicate particles. These latter particles need a larger degree of undercoooling before they become active as nuclei.

BACKGROUND OF THE INVENTION

The relative amount of silicate particles formed at the addition of magnesium at the start of the deoxidization process depends on the amount of oxygen originally present in the melt. A control of the oxygen content (dissolved oxygen) is therefore of great importance in production of compacted graphite iron. There are several means to assess the oxygen content, from direct EMF (electromotive force) based measurements to indirect methods based on thermal analysis. Such methods are known to the man skilled in the art. It must be noted, however, that direct measurements and determination of oxygen content in samples extracted under vacuum show lower results than samples poured into a sample mould, where oxygen may be absorbed from the air and from the mould material.

In liquid iron, certain reactions arc of specific importance in determining the thermodynamic conditions. First, the reduction temperature of $SiO_2$ by carbon:

$$SiO_2 + 2C \leftrightharpoons Si + 2\,CO \qquad \text{I}$$

This temperature may be referred to as the "boiling temperature" (TB) where bubbles appear as the CO-gas is expelled. This temperature is usually 50 to 100° C. above the "equilibrium temperature" (TE) at which further pick up of oxygen leads to formation of saturated $SiO_2$:

$$TE = \frac{27486}{15,47 - \log\left(\frac{Si}{C^2}\right)} - 273,15 \ [^\circ\text{ C.}] \qquad \text{II}$$

The relation between these two temperatures is given by:

$$TB = 0.7866\ TE + 362 \qquad \text{III}$$

expressing the displacement of the "boiling point". The temperature interval between TE and TB depends on the carbon and silicon content of the melt, but is commonly found between 1400° and 1500° C. In this temperature region, oxygen can readily be picked up, absorbed, by the melt. The absorption rate of oxygen, up to the point where FeO is formed, depends on the temperature difference between the actual temperature of the mel (TM) and TE. The absorption follows an exponential function. The temperature at which the melt is poured into the moulds is usually adjusted to values between TE and TB, the higher the thinner the sections in the casting of compacted graphite iron are.

In the case of producing CGI, an addition of silicon is required followed by deoxidation with magnesium. In order to calculate the amount of deoxidizing addition needed to produce CGI, the oxygen potential of the melt must be known precisely. This can be determined by calculations, calibration or by a direct or indirect measurement of the oxygen content by methods known per se.

The aim of the desoxidazation process is two-fold:

a) to precipitate Mg/Fe-silicate particles which constitute good nucleating sites for compacted—graphite crystals, and b) to reduce the oxygen content of the melt to the desired level, before pouring the melt into moulds.

Unless the process is controlled within very narrow limits, there is a great risk that flake crystals or an excess of nodular crystals appear in the casting. In the following these limits are specified.

DISCLOSURE OF THE INVENTION

Thus, the present invention relates to a method of producing objects of cast iron containing compacted (vermicular) graphite by:

a) preparing a cast iron melt, preferably with the same requirements regarding base material as is common practice for the production of ductile iron, having substantially a carbon content at the desired final level and a silicon content below the desired final value, so that the equilibrium temperature (TE) for the reaction between carbon and $SiO_2$, falls near 1400° C.;

b) adjusting the temperature of the melt (TM) to a value between the equilibrium temperature (TE) and the "boiling temperature" (TB), at which carbon monoxide (CO) is expelled from the melt, to allow absorption of oxygen by the melt to a level exceeding the desired level at the time the melt is poured into a mould, preferably to above a concentration of 50–100 ppm, adding a required amount of silicon and thereafter reducing the oxygen content by addition of magnesium or a magnesium containing material, preferably an FeSiMg-alloy to an oxygen level of 10 to 20 ppm oxygen in liquid solution, and forming, during the reduction process, particles of magnesium containing silicates.

The melt temperature (TM) may be adjusted during the absorption of oxygen to a value of at least 20° C. above TE and at most 10° C. below TB.

The addition of deoxidizing agent is preferably calculated to result in a casting containing more than 80% of compacted graphite crystals, the remainder being nodular crystals and practically no graphite flakes, in wall sections between 3 and 10 mm.

The oxygen content is suitably analysed, preferably by thermal analysis, before the addition of the oxygen reducing material.

According to one preferred embodiment the cast objects due to oxygen absorption during pouring and filing of the sand mould with the melt, attain a final amount of oxygen of: in a modulus M of 0.5 cm (wall thickness up to 10 mm) 40–60 ppm in a modulus M between 0.5 and 1.0 cm (wall thickness 10 to 20 mm) 30–50 ppm in a modulus M above 1 cm (wall thickness above 20 mm) 20–40 ppm where the proportion of the magnesium silicates to iron silicates should be >2 and an additional amount of preferably max 20 ppm oxygen is allowed to be present in other forms. In the solidified castings the oxygen is mainly found to be combined to silicates such as $FeO.SiO_2$ and $MgO.SiO_2$ and/or $2FeO.SiO_2$ and $2MgO.SiO_2$ The invention also relates to cast objects producible as disclosed above, especially engine blocks, cylinder heads, flywheels, disc brakes and similar products, in which, within the parts having a wall thickness of 3–10 mm, the carbon as graphitized, to at least 80% and, preferably at least 90%, is compacted graphite crystals, the remainder being nodular crystals and the material practically free from graphite flakes.

All parts and percentages are by weight.

Procedure

In a practical case a cast iron melt is prepared using base material with a low sulphur content as is common practice in the production of nodular cast iron. The carbon content is adjusted close to the desired final value, while the silicon content is lower than a desired final content and adjusted so that the TE temperature lies close to 1400° C. The actual melt temperature TM is now adjusted to a value slightly below TB, i.e. in the region where oxygen can be absorbed by the melt from the surrounding air at a relatively high rate. After an estimated time at a specified temperature, the oxygen content now obtained is measured, preferably by a standard thermal analysis procedure, which besides of the level of dissolved oxygen may also gives information on types of oxide inclusions and on the inherent crystallisation behaviour of the melt at this stage. The experience shows that the melt temperature should preferably be at least 20° C. above TE and 10° C. below TB and the holding time be controlled according to the starting oxygen content of the melt.

Preferably, when the oxygen level of the melt has reached a value of 50–100 ppm, the remaining amount of silicon is added so that the calculated TE now falls around 20° C. below TM. To retain high oxygen levels silicon can alternatively be added during the transfer of the melt into a treatment ladle.

EXAMPLE

At a carbon concentration of 3.6% a melt requires a silicon level of 1.4% to reach a TE of 1400° C. In this case a TB can be calculated according to the formulae stated above to equal 1460° C. By increasing the actual melt temperature TM from 1380 to 1440° C. a rapid pick up of oxygen takes place, above that required to satisfy $SiO_2$. The addition of silicon to a final concentration of 2.3% decreases the difference TM-TE whereby the further pick up of oxygen is lowered. After this step, the melt temperature is raised for a short period of time to the treatment temperature (TT) to compensate for the decrease in temperature during transfer to the treatment ladle (this descrease is in the order of 50° C.). During the transfer a further pick up of oxygen in the range of 20 ppm will occur which has to be considered in calculation of the amount of desoxidizing agent required. After the desoxidazation process, no further treatment is necessary and the melt can be poured into moulds.

During treatment of the melt with magnesium or an FeSiMg-alloy, magnesium silicates ($MgO, SiO_2$ or $2MgO, SiO_2$) as well as iron silicates ($FeO, SiO_2$ or $2FeO, SiO_2$) and mixtures like olivine may form according to the activities of silicon, oxygen and magnesium. The magnesium silicates constitute the most potent nuclei for compacted graphite crystals, while the iron containg compounds seem to be inactive.

With increasing cooling rate during solidification in the mould, i.e. sections with thinner walls, the relative number of nucleating particles must be high to prevent formation of graphite flakes and at the same time the oxygen activity must be high to prevent formation of nodular crystals.

It has empirically been found that at a wall thickness <10 mm (M<0.5 cm) an oxygen activity of 40–60 ppm is required, at M=0.5–1.0 cm (wall thickness 10–20 mm) the oxygen concentration should be 30–50 ppm and for M>1.0 (wall thickness >20 mm) an oxygen level of 20–40 ppm is required.

Oxygen is picked up during pouring and mould filling. The larger the surface to volume ratio, the higher the pick up of oxygen. Therefore the oxygen level just before pouring has to be optimised for a certain modulus.

What is claimed is:

1. A method of producing objects of cast iron containing compacted (vermicular) graphite crystals, characterized in:

a) preparing a cast iron melt suitable for the production of ductile iron, having substantially a carbon content at the desired final level and a silicon content below the desired final value, so that the equilibrium temperature (TE) for the reaction between carbon and $SiO_2$ is at least 1400° C.;

b) adjusting the temperature of the melt TM to a value between the equilibrium temperature (TE) and the boiling temperature (TB), at which carbon monoxide (CO) is expelled from the melt, to allow absorption of oxygen by the melt to a level exceeding the desired level just prior to pouring the melt into a mould, wherein said level exceeding the desired level is equivalent to a concentration of 50–100 ppm, adding an amount of silicon required in order to obtain a TE approximately 20° C. below TM, whereby further absorption of oxygen is reduced, and thereafter reducing the oxygen content by addition of at least one selected from the group consisting of: magnesium, a magnesium containing material, and a FeSiMg-alloy, to an oxygen level of 10 to 20 ppm oxygen in liquid solution, and forming, during the reduction process, particles of magnesium silicates.

2. A method according to claim 1, characterized in adjusting the melt temperature (TM) during the absorption of oxygen to a value of at least 20° C. above TE and at most 10° C. below TB.

3. A method according to claim 2, characterized in that the oxygen content is analyzed, by thermal analysis, before the addition of the oxygen reducing material.

4. A method according to claim 2, characterized in that the cast objects due to oxygen absorption during pouring and filling of a sand mould with the melt, attain a final amount of oxygen of:

40–60 ppm for a wall thickness up to 10 mm,

30–50 ppm for a wall thickness 10–20 mm,

20–40 ppm for a wall thickness above 20 mm, wherein the proportion of the magnesium silicates to iron silicates should be >2 and an additional amount of max 20 ppm oxygen is allowed to be present in other forms and in the solidified castings the oxygen is mainly found to be combined to silicates.

5. A method according to claim 1, characterized in that the addition of deoxidizing agent is calculated to result in a casting containing more than 80% of compacted graphite crystals, the remainder being nodular crystals, and substantially no graphite flakes, in wall sections between 3 and 10 mm.

6. A method according to claim 5, characterized in that the oxygen content is analyzed, by thermal analysis, before the addition of the oxygen reducing material.

7. A method according to claim 5, characterized in that the cast objects due to oxygen absorption during pouring and filling of a sand mould with the melt, attain a final amount of oxygen of:

40–60 ppm for a wall thickness up to 10 mm,

30–50 ppm for a wall thickness 10–20 mm,

20–40 ppm for a wall thickness above 20 mm, wherein the proportion of the magnesium silicates to iron silicates should be >2 and an additional amount of max 20 ppm oxygen is allowed to be present in other forms and in the solidified castings the oxygen is mainly found to be combined to silicates.

8. A method according to claim 1, characterized in that the oxygen content is analyzed, by thermal analysis, before the addition of the oxygen reducing material.

9. A method according to claim 8, characterized in that the cast objects due to oxygen absorption during pouring and filling of a sand mould with the melt, attain a final amount of oxygen of:

40–60 ppm for a wall thickness up to 10 mm,

30–50 ppm for a wall thickness 10–20 mm,

20–40 ppm for a wall thickness above 20 mm, wherein the proportion of the magnesium silicates to iron silicates should be >2 and an additional amount of max 20 ppm oxygen is allowed to be present in other forms and in the solidified castings the oxygen is mainly found to be combined to silicates.

10. A method according to claim 1, characterized in that the cast objects due to oxygen absorption during pouring and filling of a sand mould with the melt, attain a final amount of oxygen of:

40–60 ppm for a wall thickness up to 10 mm,

30–50 ppm for a wall thickness 10–20 mm,

20–40 ppm for a wall thickness above 20 mm, wherein the proportion of the magnesium silicates to iron silicates should be >2 and an additional amount of max 20 ppm oxygen is allowed to be present in other forms and in the solidified castings the oxygen is mainly found to be combined to silicates.

11. The method of claim 10, wherein the silicates are $FeOSiO_2$ and $MgOSiO_2$ or $2FeSiO_2$ and $2MgOSiO_2$.

12. The method of claim 1, wherein the TE is between greater than 1400 and up to 1500° C.

* * * * *